United States Patent [19]

Maillochaud

[11] Patent Number: 4,470,427

[45] Date of Patent: Sep. 11, 1984

[54] PRESSURE REGULATOR FOR A PUMP WITH CONTROLLED INTAKE FLOW

[75] Inventor: Jean-Claude Maillochaud, Plaisir, France

[73] Assignees: Societe Anonyme Automobiles Citroen; Societe Anonyme Automobiles Peugeot, both of Paris, France

[21] Appl. No.: 388,728

[22] Filed: Jun. 15, 1982

[30] Foreign Application Priority Data

Jun. 19, 1981 [FR] France ..... 81 12447

[51] Int. Cl.[3] ..... F04B 49/00

[52] U.S. Cl. ..... 137/112; 417/295

[58] Field of Search ..... 137/112; 417/295

[56] References Cited

U.S. PATENT DOCUMENTS

| | | | |
|---|---|---|---|
| 1,025,222 | 5/1912 | Wallace | 417/295 |
| 1,663,647 | 3/1928 | Brush | 417/295 X |
| 1,884,852 | 10/1932 | Pool | 417/295 |
| 2,019,723 | 11/1935 | Ochel | 417/295 |
| 2,916,999 | 12/1959 | Christensen | 417/295 |
| 3,982,855 | 9/1976 | Aldinger | 417/295 X |
| 4,237,926 | 12/1980 | Walker | 417/295 X |

*Primary Examiner*—Robert G. Nilson

*Attorney, Agent, or Firm*—Karl F. Ross

[57] ABSTRACT

A pressure regulator for a pump aspirating a working fluid from a tank comprises a throttle valve at a junction between an inlet pipe extending from the tank and an outlet pipe terminating at the intake port of the pump. The discharge port of the pump is connected to a control port of the regulator housing in line with the inlet pipe, this control port being separated by a partition with a narrow passage from a chamber containing the shiftable valve body. The passage accommodates a small-diameter rod which has a flat tail penetrating that passage only when the discharge pressure of the pump has reached a certain threshold above a point at which that pressure has caused the rod to move the valve body into a blocking position against a countervailing spring pressure. This establishes a connection between the discharge and intake ports of the pump preventing further rises in the pump's delivery pressure.

4 Claims, 3 Drawing Figures

PRESSURE REGULATOR FOR A PUMP WITH CONTROLLED INTAKE FLOW

FIELD OF THE INVENTION

My present invention relates to a pump provided with a pressure regulator operating by throttling the flow of a fluid aspirated by the pump during its suction stroke.

BACKGROUND OF THE INVENTION

A pressure regulator of this type, which may be an integral part of the pump or may constitute a separate element, generally comprises throttling means movable against the action of elastic restoring means and interposed between a pipe for connection to a tank and a pipe for connection to the suction or intake port of the pump, the throttling means being displaceable by an element having one end received in a pipe or a chamber connectable to the delivery or discharge port of the pump, so that the delivery pressure acts on this element.

A pump provided with a regulator of the above type necessarily comprises a pressure limiter, inasmuch as one cannot be certain of the tightness of the throttling. If a leakage occurs in a position in which the connection between the tank and the suction port is supposed to be cut off, a pressure increase may occur which is to be controlled by the pressure limiter. Such a pressure limiter generally comprises a valve which opens against elastic means when the delivery pressure of the pump reaches a safety threshold, thereby connecting the delivery port of the pump with the tank.

Swiss Pat. No. 205 990 describes a pressure limiter of this type which is associated with a compressor and which, when the safety threshold is attained, isolates the suction port from the compressor and simultaneously places the delivery port thereof in communication with the tank, upstream of the pressure regulator. This results in that the suction port of the compressor is at an underpressure and that leakages may occur.

OBJECT OF THE INVENTION

It is the object of my present invention to provide a pressure regulator operating by throttling during the suction stroke and incorporating a pressure limiter designed to obviate the above-mentioned drawback.

SUMMARY OF THE INVENTION

The control element of a pressure regulator embodying my invention establishes communication between a control port connectable to the delivery port of the pump and an outlet connectable to the suction port of this pump when it has moved by a distance at least equal to that corresponding to total cutoff.

With my improved regulator the delivery pressure, which acts on the control element, tends to displace the throttling means toward a blocking position against the action of the elastic restoring means. At a certain threshold of the delivery pressure, blocking is total, i.e. communication between the inlet and the outlet respectively connected to the tank and the intake port of the pump is interrupted. If lack of tightness of the throttling means causes a further increase in the delivery pressure, the control element continues to move and, at a second threshold of the pressure, establishes communication of the delivery port of the pump with the suction port thereof; therefore, the pressure can in no case exceed this second threshold.

The throttling means may for example comprise a valve of sliding-sleeve or of plug type adapted to obstruct at least one orifice, the control element being maintained by the delivery pressure in contact with the slide or plug valve.

In a particular embodiment of the invention, the control element is constituted by a rod which is of substantially smaller cross-section than the valve body controlled thereby and passes through a wall separating the control port connectable to the delivery port from a chamber forming a junction between the inlet and the outlet of the regulator housing, the rod being cut flat over part of its length so as to have a tail of reduced cross-sectional area. In normal operation, the flat tail portion does not pass completely through the wall whereby the delivery port of the pump remains isolated from the intake port. However, when the rod has moved by a sufficient distance, the flat portion passes through the wall so that the two ports are interconnected.

BRIEF DESCRIPTION OF THE DRAWING

The above and other features of my invention will now be described in detail with reference to the accompanying drawing in which.

SPECIFIC DESCRIPTION

Figure 1:
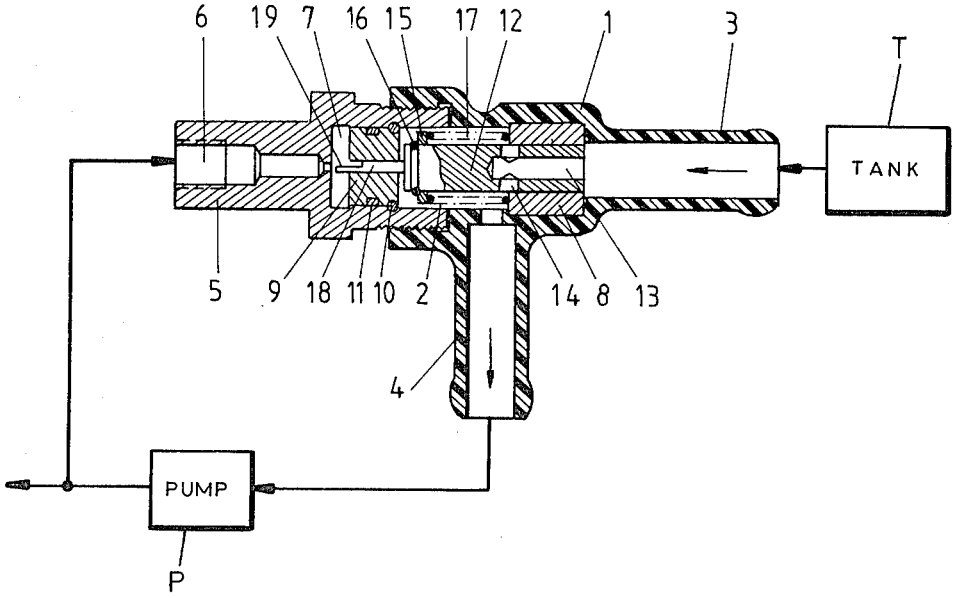
FIG. 1 is a view in axial section of a first embodiment.

As shown in FIG. 1, a pressure regulator according to my invention comprises a housing 1 of plastic material, for example, having a chamber 2. Housing 1 is fast with an axial inlet pipe 3 and with a lateral outlet pipe 4. Pipes 3 and 4 both open into chamber 2, forming a junction between them, and are adapted to be respectively connected to a tank T containing a working fluid and to the intake port of a pump P. A high-pressure union 5, made for example of cast iron, is screwed into the end of the body 1 opposite pipe 3. This union has a control port in the form of an axial bore 6 adapted to be connected to the delivery port of the pump, i.e. to high pressure, and a recess 7 which forms an extension of chamber 2.

A sleeve 8, here shown as made of metal, is fitted in an enlarged part of chamber 2 on the side of inlet pipe 3. A second sleeve 9 is fixed in recess 7 by a stop ring 10 and carries on its periphery an O-ring 11.

A valve member 12, slidably mounted in the sleeve 8, has an axial bore 13 in communication with the pipe 3 and one or more radial holes 14 opening into the bore 13. A ring 15 is immobilized by a stop ring 16 on the end of the slide valve 12 opposite the sleeve 8. A restoring spring 17, interposed between this sleeve and the ring 15, tends to move the slide valve 12 toward the left so as to unblock the holes 14 and to maintain the valve body in contact with a much thinner push rod 18 which is slidable in a narrow passage of sleeve 9 and subjected to the high discharge pressure of pump P.

A tail portion of the rod 18 located on the high-pressure side, i.e. adjacent the bore 6, is provided with a flat face 19 parallel to the direction of motion.

The high pressure acts on the rod 18 which pushes the slide valve 12 toward the right against the force of the spring 17. The holes 14 are thus more or less obstructed by the sleeve 8, thereby throttling the flow aspirated by the pump and regulating the high pressure at its discharge port.

At a first high-pressure threshold, the holes 14 are totally obstructed by the sleeve 8 so that the suction port of the pump P is isolated from the tank T. The flat portion 19 of the push rod 18 has such a length that, in this position of the slide valve 12, it does not enter the right-hand part of recess 7 in communication with chamber 2.

However, the blocking effect of sleeve 8 is not necessarily absolute whereby the value of the high pressure may increase further, so that the assembly of rod 18 and valve 12 continues to move to the right against the force of the spring 17.

At a second high-pressure threshold, the flat portion 19 passes completely through the sleeve 9 so that the delivery port of the pump is placed in communication with its suction port; the value of the high pressure can then no longer increase. Even if the blocking is imperfect, there can be no leakage from the tank T but any such leakage will pass toward this tank.

Figure 2:
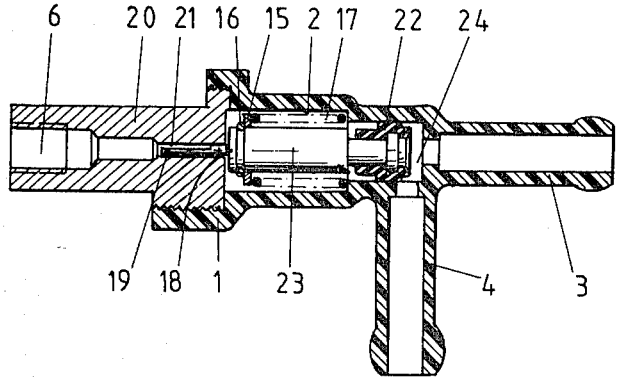
FIG. 2 is a view similar to FIG. 1, showing a second embodiment.
Figure 2A:
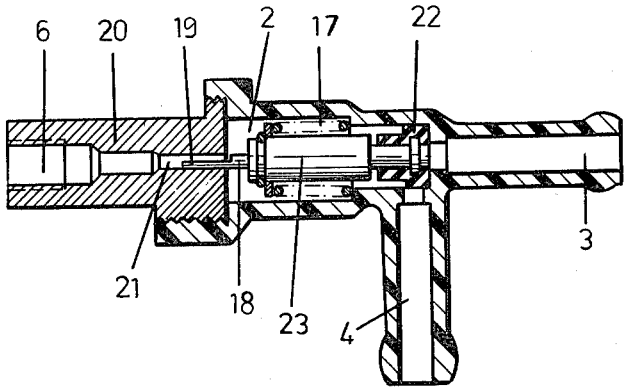
FIG. 2A shows the embodiment of FIG. 2 in an alternate position.

The embodiment of FIG. 2 is similar in its general outline to that of FIG. 1. However, the union 5 and the sleeve 9 are here replaced by a single piece 20 containing the axial bore 6 and a smaller-diameter extension 21 thereof receiving the push rod 18. Furthermore, the slide valve 12 is replaced by an elastic valve member in the form of a plug 22 carried by a support 23 on which is mounted the ring 15 and which abuts the push rod 18. If the discharge pressure of the pump continues to increase when the plug 22 of valve body 22, 23 is displaced by this high pressure onto a seat 24 coaxial with pipe 3, the plug deforms elastically so as to allow the flat portion 19 to clear the passage 21 and to give the bore 6 access to chamber 2 which in turn is able to communicate with conduit 4, as shown in FIG. 2A.

What is claimed is:

1. A pressure regulator for a pump having an intake port connected to a tank and a discharge port emitting fluid at high pressure, comprising:

a housing with an inlet connectable to said tank, an outlet connectable to said intake port, and a control port connectable to said discharge port, said housing being provided with a chamber forming a junction between said inlet and said outlet;

a partition between said control port and said housing provided with a narrow passage of substantially smaller cross-section than said chamber;

a valve body in said chamber slidably inserted between said partition and said junction;

spring means in said chamber biasing said valve body toward said partition; and a rod in said passage having a cross-sectional area substantially smaller than that of said valve body and contacting the latter, said rod bearing upon said valve body under fluid pressure from said discharge port and having a reduced tail portion remote from said valve body clearing said passage only in a position of said valve body blocking said inlet while rendering said outlet accessible from said passage.

2. A pressure regulator as defined in claim 1 wherein said inlet and outlet have axes respectively in line with and transverse to the direction of sliding motion of said valve body, said chamber forming a guide sleeve for said valve body between said outlet and said inlet, said valve body having an axial bore open toward said inlet and at least one radial orifice connecting said bore with said outlet in a retracted position of said valve body.

3. A pressure regulator as defined in claim 1 wherein said valve body includes a deformable plug unblocking said outlet upon being pressed by said rod onto a seat surrounding said inlet.

4. A pressure regulator as defined in claim 1 wherein said tail portion has a flat face parallel to the direction of sliding motion of said valve body.

* * * * *